US005728975A

United States Patent [19]

Tanaka

[11] Patent Number: 5,728,975

[45] Date of Patent: Mar. 17, 1998

[54] CONNECTING STRUCTURE FOR FLAT CABLE

[75] Inventor: Yoshiyuki Tanaka, Shizuoka-ken, Japan

[73] Assignee: Yazaki Corporation, Tokyo, Japan

[21] Appl. No.: 580,451

[22] Filed: Dec. 27, 1995

[30] Foreign Application Priority Data

Dec. 27, 1994 [JP] Japan ..... 6-325938

[51] Int. Cl.[6] ..... H01R 43/04

[52] U.S. Cl. ..... 174/88 B; 439/115

[58] Field of Search ..... 174/88 B, 129 B, 174/133 B, 117 F; 439/115, 210, 212, 213

[56] References Cited

U.S. PATENT DOCUMENTS

| | | | |
|---|---|---|---|
| 2,798,898 | 7/1957 | Popovich et al. | 174/72 B X |
| 2,824,901 | 2/1958 | Reichert et al. | 174/72 B X |
| 4,406,915 | 9/1983 | Lang | 174/117 F |
| 5,008,494 | 4/1991 | Wagener | 174/68.2 X |
| 5,206,462 | 4/1993 | Iura et al. | 174/117 F |
| 5,535,513 | 7/1996 | Frantz | 29/882 X |

FOREIGN PATENT DOCUMENTS

P 5-62754 12/1993 Japan .

*Primary Examiner*—Kristine L. Kincaid
*Assistant Examiner*—Chau N. Nguyen
*Attorney, Agent, or Firm*—Wigman, Cohen, Leitner & Myers, P.C.

[57] ABSTRACT

A connecting structure for completing an electrical connection between a flat cable and bus bars is provided. The flat cable is provided at an end portion thereof with an exposed conductive part and an ear part arranged on a tip of the flat cable. By bending the exposed conductive part in a direction perpendicular to the plane of the flat cable, the ear part is arranged perpendicular to an extending direction of the flat cable. The bus-bar unit has first and second setting surfaces, a plurality of exposed parts of the bus bars arranged on the first setting surface and an ear holding part arranged on the second setting surface. In the arrangement, the ear part of the flat cable is attached to the ear holding part while the exposed conductive part of the cable is attached to the first setting surface. As the setting surface of the exposed conductive part is arranged perpendicular to the setting surface of the ear part, there is no need to ensure a space for holding the ear part in an extension line of the flat cable.

26 Claims, 4 Drawing Sheets

CONNECTING STRUCTURE FOR FLAT CABLE

BACKGROUND OF THE INVENTION

1. Technical Field

The present invention relates to a connecting structure for connecting a flat cable to bus bars in an electrical wiring system of an automobile or the like.

2. Description of the Related Art

For example, in the case of executing electrical wiring for functional parts which are arranged at a center of a steering wheel section of an automobile, it is necessary to connect an immovable part to a movable (rotatable) part electrically. As means for completing such an electrical connection, there is known a connecting structure where a space is defined between the immovable part (stator) of the steering wheel section and the rotatable part (rotor) and, furthermore, a spirally wound flexible flat cable to be connected to both the stator and the rotor is accommodated in the space so that a relative rotational displacement between the immovable part and the rotatable part is absorbed in the flat cable. This structure is results from the flexibility of the flat cable, thereby allowing the stator to be electrically connected to the rotor without using a brush.

In such a structure as mentioned above, it is general practice to connect an end of the flat cable to lead wires through the intermediary of bus bars (e.g. Japanese Unexamined Patent Publication No. 5-62754). The reason why such a connecting form is adopted is as follows. That is, it should be noted that the flat cable consists of a number of extremely thin leaves of copper, both surfaces of which are coated with flexible thin resinous layers. Therefore, the flexible flat cable is characterized by its remarkable fragility to an external force, so that it is difficult to connect the flat cable to the outside lead wires directly.

Incidentally, in connecting the flat cable to the bus bars, it is difficult to adjust individual exposed conductors of the flat cable, as they are, to the corresponding bus bars. Therefore, in the conventional structure, the exposed conductors have been provided while leaving an unexposed cable part at the tip of the flat cable in order to maintain distances (pitches) among the individual conductors of the cable. With this arrangement, the flat cable has been temporarily engaged in a bus-bar unit having bus bars. It should be noted that the above-mentioned unexposed insulative cable part will be referred as "an ear part" hereinafter.

We now describe the structure of the conventional bus-bar unit in brief.

The conventional bus-bar unit, which is normally made of resinous material, includes a plurality of bus bars molded therein. These bus bars are arranged therein so as to correspond to respective conductors of the flat cable. In addition, the bus-bar unit is provided on one wall thereof with a first setting surface for mounting the above-mentioned exposed conductors thereon and a neighboring second setting surface for mounting the above ear part thereon. Both the first setting surface and the second setting surface are positioned in an extension line of the flat cable. Furthermore, the second setting surface is provided with a holding frame for supporting the ear part. On the other hand, the first setting surface assigned for the exposed conductors is provided with an opening through which the bus bars are partially exposed to the outside.

In order to connect the flat cable to the so-constructed conventional bus-bar unit, the ear part is abutted against the above holding frame standing on the second setting surface, and the exposed conductors are mounted on the first setting surface. Thus, the ear part of the cable can be adjusted and held in position by the holding frame, whereby the flat cable can be temporarily engaged with the bus-bar unit. Thereafter, the exposed conductors are joined to conductive parts of the bus bars exposed through the above opening by joint means such as solder. The conventional connecting structure between the flat cable and the bus-bar unit has been provided in the above-mentioned way.

In the conventional connecting structure, however, since the first and second setting surfaces are defined on the common wall, in other words, since the second setting surface is positioned in an extension line of the first setting surface, there has been a problem in that a dimension of the bus-bar unit increases in an extending direction of the flat cable. Therefore, depending on an area where the bus-bar unit is to be established, it is impossible to bring the bus-bar unit into a required position.

SUMMARY OF THE INVENTION

It is therefore an object of the present invention to provide a connecting structure for a flat cable, which is capable of decreasing a dimension of a bus-bar unit in the extending direction of the flat cable, and which can prevent pitches among conductors of the flat cable from varying from normal pitches, and which can engage the flat cable with the bus-bar unit temporarily.

The object of the present invention described above can be accomplished by a connecting structure comprising:

- a flat cable having a plurality of conductors arranged at predetermined intervals and an insulator for overlapping the conductors;and
- a bus-bar unit having a plurality of bus bars corresponding to the conductors of the flat cable;
- wherein the flat cable further has an exposed conductive part provided by eliminating the insulator partially and an ear part arranged on a tip of the flat cable and composed of unexposed insulative parts, the ear part extending in a direction perpendicular to the longitudinal extent of the flat cable by bending the conductors at the exposed conductive part so that they extend in a direction perpendicular to the plane of the flat cable;
- wherein the bus-bar unit further has first and second setting surfaces bent at right angles to each other to follow a longitudinal direction of the flat cable, a plurality of exposed parts of the bus bars arranged on the first setting surface and supported thereon at predetermined intervals by resinous molding, and an ear holding part arranged on the second setting surface for supporting the ear part of the flat cable;
- wherein the ear part of the flat cable is attached to the ear holding part;
- wherein the exposed conductive part of the flat cable is attached to the first setting surface so that the conductors at the exposed conductive part correspond to the exposed parts of the bus bars, respectively; and
- wherein the conductors at the exposed conductive part of the flat cable in the attached condition are joined to the exposed parts of the bus bars through joint means.

With the arrangement mentioned above, since the flat cable is connected to the bus bars while leaving the ear part, it is possible to prevent the conductors of the flat cable from getting out of their respective normal positions. Additionally, since the flat cable can be temporarily engaged in the bus-bar unit by setting the ear part on the ear holding part of the unit, it is possible to join the conductors at the exposed conductive part of the cable to the bus bars under its stable condition. Furthermore, as the setting surface of the exposed conductive part is arranged perpendicular to the setting surface of the ear part, there is no need to ensure a space for holding the ear part in an extension line of the flat cable. Thus, it is possible to shorten a dimension of the bus-bar unit in the extending direction of the flat cable.

In the present invention, preferably, the bus-bar unit is made from a resinous block having a first wall part, a third wall part and a second wall part connecting the first wall part to the third wall part.

Preferably, the first setting surface is defined on the first wall part while the second setting surface is defined on the second wall part, and the third wall part is provided with a third setting surface for setting lead wires.

Preferably, the bus bars penetrate the first wall part, the second wall part and the third wall part in succession, and the bus bars are partially exposed at the first setting surface and the third setting surface.

It is more preferable that the exposed conductive part of the flat cable be attached on the first setting surface and the ear part of the flat cable be attached on the second setting surface, while the lead wires are attached on the third setting surface. In addition, it is preferable that the joint means operate to join the conductors at the exposed conductive parts of the flat cable to the exposed parts of the bus bars at the first setting surface and to join exposed conductors of the lead wires to the exposed parts of the bus bars at the third setting surface.

With the above-mentioned preferable arrangements, by joining the flat cable and the lead wires to the bus-bar unit, the flat cable can be connected to the lead wires mutually.

In the present invention, preferably, the connecting structure further includes a holder which is detachably attached to the bus-bar unit for holding the ear part of the flat cable on the second setting surface.

In such a case, it is possible to support the ear part of the cable securely by attaching the holder, thereby making sure of temporary engagement of the cable with the bus-bar unit.

More preferably, the holder includes a rectangular frame part, an ear holding wall for holding the ear part of the flat cable, locking pieces, and engagement recesses for engagement with the bus-bar unit.

With the arrangement, the holder can be attached to the bus-bar unit.

Alternatively, it is preferable that the bus-bar unit be provided on respective sides of the ear holding part with engagement grooves into which respective lateral edges of the ear part of the flat cable are inserted, and that respective lateral edges of the ear holding wall of the holder also be inserted into the engagement grooves.

In this case, owing to the provision of engagement grooves, the positioning of the ear holding wall in the bus-bar unit can be attained without the above engagement recesses.

These and other objects and features of the present invention will become more fully apparent from the following description and appended claims taken in conjunction with the accompany drawing.

DESCRIPTION OF THE PREFERRED EMBODIMENT

Figure 2:
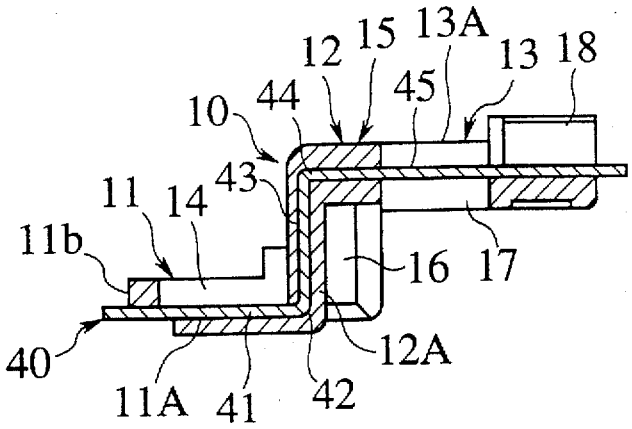
FIG. 2 is a cross sectional view of the connecting structure, taken along a line II—II of FIG. 1.
Figure 3:
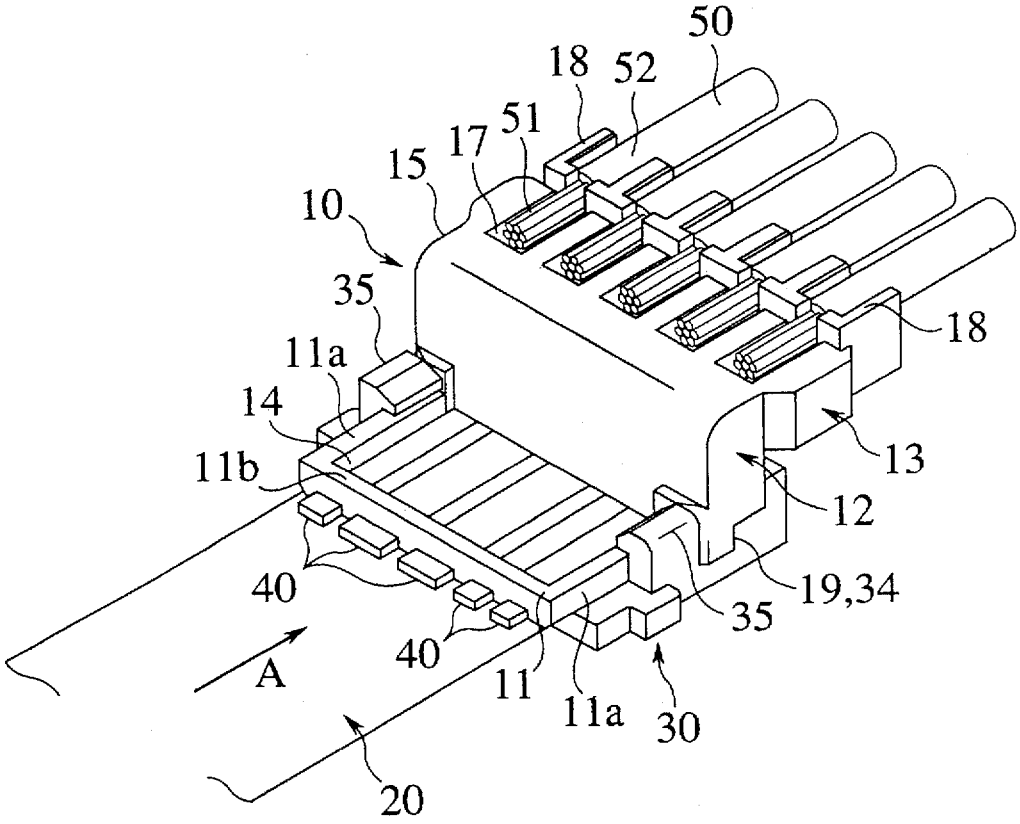
FIG. 3 is a perspective view showing the connecting structure of FIG. 1 in its assembled condition.

The embodiments of the present invention will be described with reference to the drawings. In the figures, FIG. 1 is a perspective view of a connecting structure, FIG. 2 is a cross sectional view taken along a line II—II of FIG. 1, and FIG. 3 is a perspective view of the structure in its assembled condition.

Figure 1:
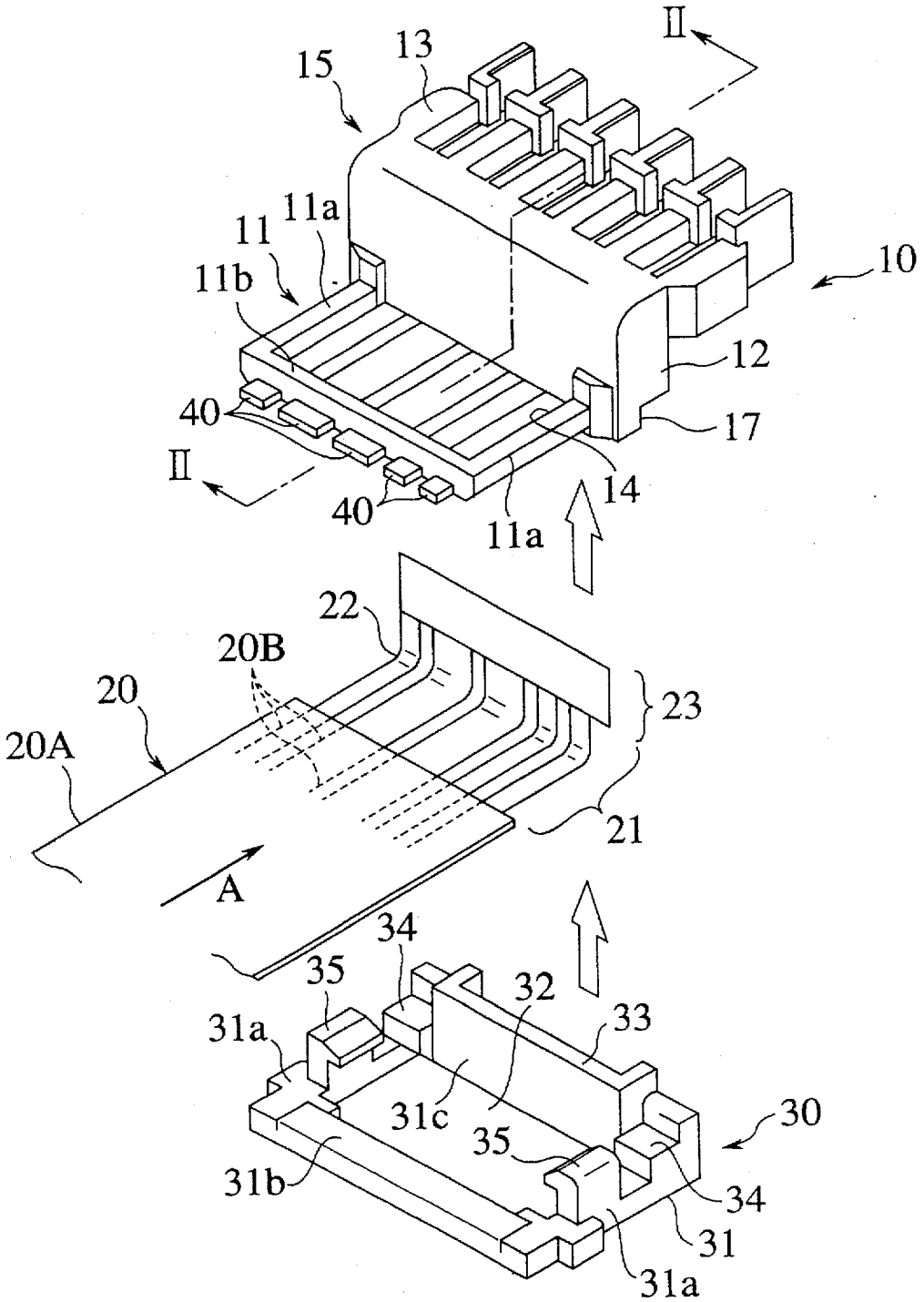
FIG. 1 is a perspective view showing a disassembled connecting structure for a flat cable in accordance with a first embodiment of the present invention.

In FIG. 1, reference numeral 10 designates a bus-bar unit, 20 a flat cable, and 30 a holder. The holder 30 is an element to be fitted in the bus-bar unit 10 after attaching the flat cable 20 thereto.

The flat cable 20 has a plurality of conductors 20B which are arranged at predetermined intervals and interposed between two sheets of synthetic resinous films (insulator) 20A. Formed on an end portion of the flat cable 20 is an exposed conductive part 21 at which the conductors 20B are exposed by eliminating the synthetic resinous films 20A. On a leading end of the exposed conductive part 21, an ear part 23 is formed by leaving the synthetic resinous films 20A of a constant length. Since a portion 22 of the exposed conductive part 21 is bent at right angles so as to extend in a direction perpendicular to a plane of the flat cable 20, the ear part 23 extends in a direction perpendicular to the longitudinal extent (shown with an arrow A of FIG. 1) of the flat cable 20.

The bus-bar unit 10 consists of plural pieces of bus bars 40 and a molded resinous block 15. The resinous block 15 has a Z-shaped cross section composed of a rectangular-shaped second wall part 12 positioned at a center thereof, a first wall part 11 projecting from a lower portion of the second wall part 12 forward, and a third wall part 13 projecting from an upper portion of the second wall part 12 backward.

The first wall part 11, which is in the form of a rectangular frame having a central opening 14, comprises a pair of lengthwise frame elements **11*a* on the left and right sides and a transverse frame element 11*b* on the front side. An under surface of the first wall part 11 provides a first setting surface 11A for setting the exposed conductive part 21 of the flat cable 20**.

A back surface of the second wall part 12 constitutes a second setting surface 12A for setting the ear part 23 of the flat cable 20. Although the second setting surface 12A is positioned perpendicular to the first setting surface 11A, the former is formed so as to be continuous to the latter through a smoothly bent surface. The second setting surface 12A is provided with a holding part 16 for supporting the ear part 23. In the embodiment, the ear part 16 is formed to have a recess.

The third wall part 13 is provided at a center thereof with openings 17, the common upper surface of which provides a third setting surface 13A for setting lead wires 50. At a tip of the third setting surface 13A, there is formed a holding part 18 for holding respective insulating end portions 52 of the lead wires 50 so as to bring exposed conductive parts 51 on the opening 17 through grooves **18*a* at the tip of the holding part 18**.

The bus bars 40 are arranged at predetermined intervals corresponding to the conductors 20B of the flat cable 20 and bent at two bending points 42, 44 in opposite directions, thereby providing Z-shaped deforming. Further, the bus bars 40 are arranged to penetrate through the first wall part 11, the second wall part 12 and the third wall part 13 in succession. Note that, in the embodiment, respective straight parts of the bus bars 40 will be referred as "a first straight part 41", "a second straight part 43" and "a third straight part 45" in turn, hereinafter.

The first straight part (exposed parts of the bus bars) 41 assigned to the first wall part 11 is exposed entirely at the first setting surface 11A and also exposed in the opening 14 of the first wall part 11. On the other hand, the second straight part 43 between the two bending points 42 and 44 is embedded in the second wall part 12. Further, the straight part (exposed parts of the bus bars) 45 assigned to the third wall part 13 is exposed entirely at the third setting surface 13A, and is also exposed in the openings 17 of the third wall part 13.

The holder 30, which is attached to the bus-bar unit 10 so as to overlay the first setting surface 11A, comprises a rectangular frame part 31 having an opening 32 surrounded by four sides 31*a*, 31*a*, 31*b* and 31*c*, an ear holding wall 33 projecting from the side 31*c* of the frame part 31, locking pieces 35 projecting from the opposing sides 31*a*, 31*a*, and engagement recesses 34 formed on both sides of the ear holding wall 34. The ear holding wall 33 is formed to have a substantial C-shaped cross section so as to accord with a configuration of the ear holding part 16.

We now describe assembling steps of the above-mentioned connecting structure.

Upon maintaining the position of the bus-bar unit 10 as shown in FIG. 1, the flat cable 20 is attached to the under surface of the unit 10 at first. In detail, the ear part 23 of the flat cable 20 is inserted into the ear holding part (frame) 16. Simultaneously, the exposed conductive part 21 of the flat cable 20 is mounted on the first setting surface 11A, so that the exposed conductors (part) 20B at the part 21 are overlaid on the first straight part 41 of the bus bars 40.

Then, upon keeping the above-mentioned condition, the holder 30 is attached to the bus-bar unit 10 so as to overlay on the first setting surface 11A. That is, the frame part 31 of the holder 30 is abutted on the under surface of the first wall part 11 thereby to engage the locking pieces 35, 35 in the lengthwise frame 11*a*, 11*a* of the first wall part 11. Simultaneously, the ear holding wall 33 is inserted into the ear holding part 16 provided on the second setting surface 12A. Consequently, the ear part 23 of the flat cable 20 is interposed between the ear holding wall 33 and the second setting surface 12*a* while the surroundings of the exposed conductive part 21 are interposed between the frame part 31 and the first wall part 11, whereby the flat cable 20 can be temporarily engaged in the bus-bar unit 10 securely.

Further, both the exposed conductive part 21 and the first straight part 41 can be maintained so as to expose themselves to the outside through the opening 14. Then, since engagement projections 19 at the lower end of the second wall part 12 engage in the engagement recesses 34 on both sides of the ear holding wall 33 of the holder 30, respectively, the positioning of the ear holding wall 33 can be attained.

Next, the respective insulating end portions 52 of the lead wires 50 are fitted into the holding parts 18*a* on the third setting surface 13A so that the exposed conductive parts 51 of the lead wires 50 overlap with the third straight part 44 of the bus bars 40.

Under such a condition, the bus-bar unit 10 is then immersed in the solder bath. Consequently, the exposed conductors 20B at the part 21 of the flat cable 20 are joined to the first straight part (exposed parts) 41 of the bus bars 40, respectively, while the exposed conductive part (conductors) 51 of the lead wires 50 is joined to the third straight part 45 of the bus bars 40, respectively, so that the flat cable 20 is connected to the lead wires 50, thereby providing the connecting structure for flat cable 20 in the embodiment.

In this way, by connecting the end portions of the flat cable 20 to the bus bars 40 but remaining the ear part 23, it is possible to connect the flat cable 20 to the bus bars 40 under condition that the cable 20 is temporarily fixed on the bus bars 40 securely while preventing the conductors 20B of the cable 20 from being deviated from the respective normal positions. Additionally, it is possible to connect the flat cable 20 to the lead wires 50 through the intermediary of the bus bars 40.

Furthermore, according to the embodiment, since the setting surface 11A of the exposed conductive part 21 of the flat cable 20 is arranged perpendicular to the setting surface 12B of the ear part 23, there is no need to ensure a space for holding the ear part 23 on an extension of the flat cable 20 (in the direction A), so that it is possible to shorten a dimension of the bus-bar unit 10 in the extending direction of the flat cable 20. Therefore, it is unnecessary to decrease a dimension of conductor-joint portion in the unit 10, whereby a sufficient joint area can be ensured in the connecting structure of the embodiment.

Figure 4:
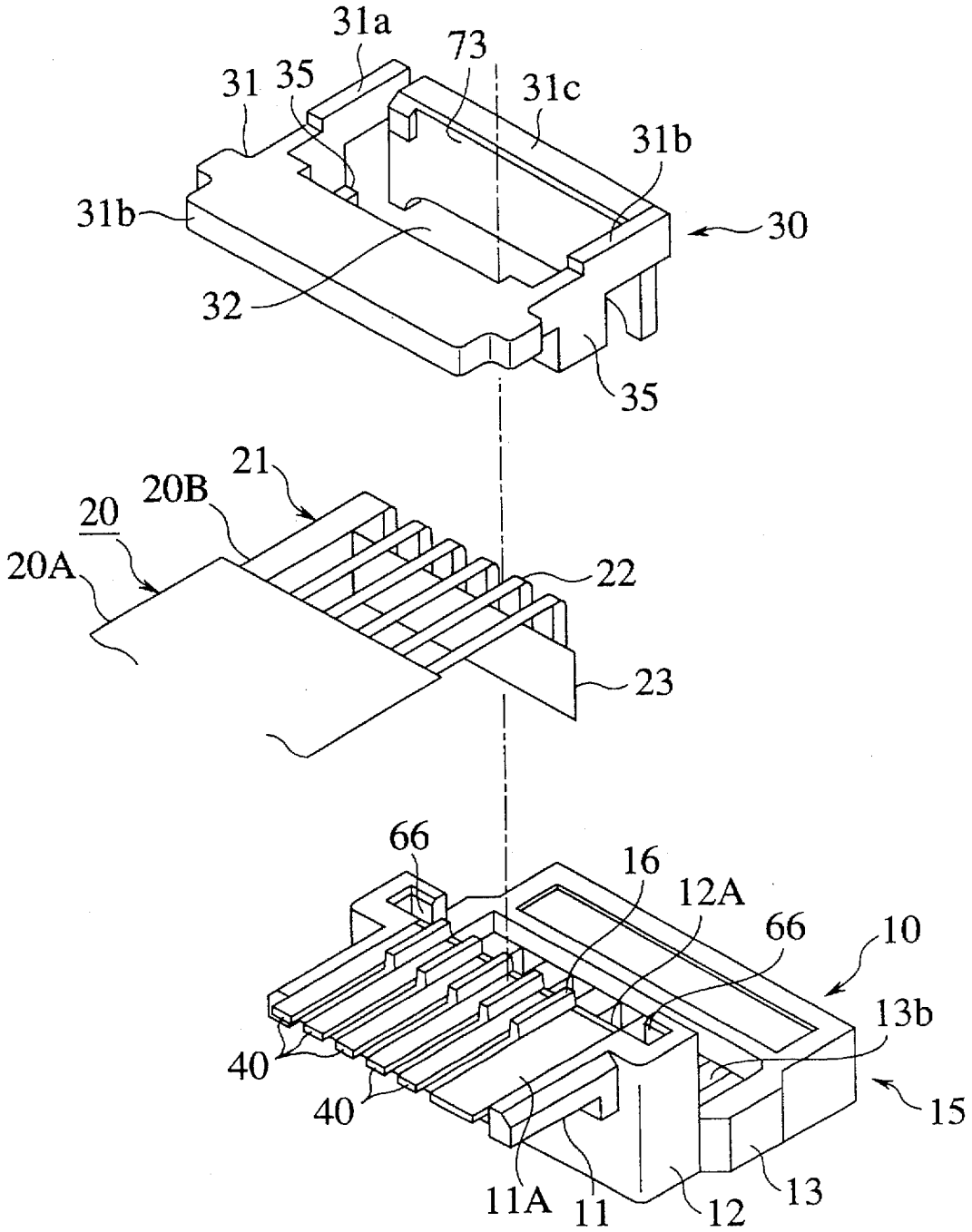
FIG. 4 is a perspective back view showing a disassembled connecting structure for a flat cable in accordance with a second embodiment of the present invention.
Figure 5:
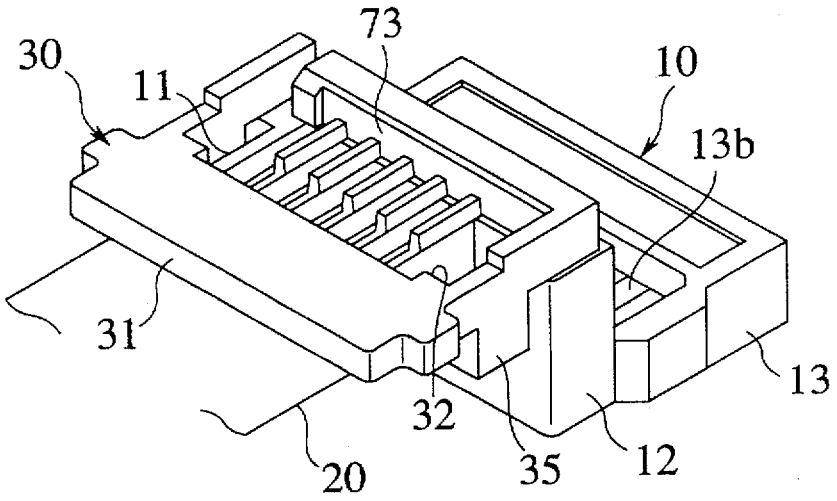
FIG. 5 is a perspective view showing the connecting structure of FIG. 4 in its assembled condition.

Another embodiment will be described hereinafter. FIG. 4 is a perspective view of a connecting structure in accordance with the embodiment in its disassembled condition, and FIG. 5 is a perspective view of the connecting structure in the assembled condition. Note that the structures shown in FIGS. 4 and 5 are turned upside down in comparison with those of the first embodiment shown in FIG. 1 and 2. Elements of the embodiment similar to those in the first embodiment are indicated with the same reference numerals, respectively.

According to the embodiment, the bus-bar unit 10 is provided on respective sides of the ear holding part 16 with engagement grooves 66 into which the ear part 23 is to be inserted. Further, the holder 30 has an ear holding wall 73 formed by a simple flat plate, respective lateral edges of which are inserted into the engagement grooves 66. That is, according to the embodiment, since the positioning of the ear holding wall 73 can be attained owing to the above insertion into the grooves 66, there is no need to provide the engagement recesses 34 and the engagement projections 19 as shown in the previous embodiment. It should be noted that other features and effects are similar to those in the previous embodiment.

Finally, it will be understood by those skilled in the art that the foregoing description is one of preferred embodiments of the disclosed key plate structure, and that various changes and modifications may be made to the present invention without departing from the spirit and scope thereof.

What is claimed is:

1. A connecting structure, comprising:

a flat cable having a plurality of conductors arranged at predetermined intervals and an insulator overlying said conductors; and a bus-bar unit having a plurality of bus bars corresponding to said conductors of said flat cable;

wherein said flat cable further includes an exposed conductive part provided by eliminating said insulator partially and an ear part arranged on a tip of said flat cable and composed of uneliminated insulator, said ear part being arranged perpendicular to an extending direction of said flat cable by bending said conductors at said exposed conductive part in a direction perpendicular to a plane of said flat cable;

wherein said bus-bar unit further includes first and second setting surfaces perpendicular to each other so as to follow a longitudinal direction of said flat cable, a plurality of exposed parts of said bus bars arranged on said first setting surface and supported thereon at predetermined intervals, and an ear holding part arranged on said second setting surface for supporting said ear part of said flat cable;

wherein said ear part of said flat cable is attached to said ear holding part;

wherein said exposed conductive part of said flat cable is mounted on said first setting surface so that said conductors at said exposed conductive part correspond to said exposed parts of said bus bars, respectively; and said structure further comprising joint means for joining said exposed conductors at said exposed conductive part of said flat cable in a mounted condition to said exposed parts of said bus bars.

2. A connecting structure as claimed in claim 1, wherein said bus-bar unit comprises a resinous block which has a Z-shaped cross section including a first wall part, a second wall part and a third wall part, said first and third wall parts being in parallel with each other and extending opposite to each other, said second wall part connecting said first wall part to said third wall part.

3. A connecting structure as claimed in claim 2, wherein said first setting surface is defined on said first wall part and said second setting surface is defined on said second wall part, and wherein said third wall part is provided with a third setting surface for setting lead wires.

4. A connecting structure as claimed in claim 3, wherein said bus bars penetrate said first wall part, said second wall part and said third wall part in succession, and wherein said bus bars are partially exposed at said first setting surface and said third setting surface.

5. A connecting structure as claimed in claim 4, wherein said exposed conductive part of said flat cable is mounted on said first setting surface and said ear part of said flat cable is mounted on said second setting surface while said lead wires are attached on said third setting surface, and wherein said joint means operates to join said exposed conductors at said exposed conductive part of said flat cable to said exposed parts of said bus bars at said first setting surface and further operates to join exposed conductor parts of said lead wires to said exposed parts of said bus bars at said third setting surface.

6. A connecting structure as claimed in claim 1, further comprising a holder detachably attached to said bus-bar unit for holding said ear part of said flat cable on said second setting surface.

7. A connecting structure as claimed in claim 6, wherein said holder comprises a rectangular frame part, an ear holding wall for holding said ear part of said flat cable, locking pieces and engagement recesses for engagement with said bus-bar unit.

8. A connecting structure as claimed in claim 6, wherein said bus-bar unit is provided on respective sides of said ear holding part with engagement grooves into which respective lateral edges of said ear part of said flat cable are inserted.

9. A connecting structure as claimed in claim 8, wherein respective lateral edges of said ear holding wall of said holder are also inserted into said engagement grooves.

10. A connecting structure as claimed in claim 5, further comprising a holder detachably attached to said bus bar unit for holding said ear part of said flat cable on said second setting surface.

11. A connecting structure, comprising:

a flat cable having a plurality of conductors arranged at predetermined intervals, an insulator overlying said conductors, and an ear part arranged on a tip of said flat cable uncovered by said insulator; and a bus-bar unit having a plurality of bus bars corresponding to said conductors of said flat cable;

wherein said bus-bar unit further comprises first and second setting surfaces perpendicular to each other so as to follow a longitudinal direction of said flat cable, and an ear holding part arranged on said second setting surface for supporting said ear part of said flat cable.

12. A connecting structure as claimed in claim 11, wherein said bus-bar unit comprises a resinous block having a Z-shaped cross-section including a first wall part, a second wall part and a third wall part, said first and third wall parts being disposed in parallel with each other and extending in directions opposite to each other, said second wall part connecting said first wall part to said third wall part.

13. A connecting structure as claimed in claim 12, wherein said first setting surface is defined on said first wall part and said second setting surface is defined on said second wall part, and wherein said third wall part is provided with a third setting surface for setting lead wires.

14. A connecting structure as claimed in claim 13, wherein said bus bars penetrate said first wall part, said second wall part and said third wall part in succession, and wherein said bus bars are partially exposed at said first setting surface and said third setting surface.

15. A connecting structure as claimed in claim 14, wherein an exposed conductive part of said flat cable is mounted on said first setting surface and said ear part of said flat cable is mounted on said second setting surface, said lead wires being attached to said third setting surface, wherein said flat cable further includes said exposed conductive part provided by eliminating said insulator partially, said structure further comprising joint means for joining exposed conductors at said exposed conductive part of said flat cable to exposed parts of said bus bars at said first setting surface, said joint means further joining exposed conductor parts of said lead wires to said exposed parts of said bus bars at said third setting surface.

16. A connecting structure as claimed in claim 15, further comprising holder means detachably attached to said bus-bar unit for holding said ear part of said flat cable on said second setting surface.

17. A connecting structure as claimed in claim 16, wherein said holder means comprises a rectangular frame part, an ear holding wall for holding said ear part of said flat cable, locking pieces, and engagement recesses for engagement with said bus-bar unit.

18. A connecting structure as claimed in claim 16, wherein said bus-bar unit is provided on respective sides of said ear holding part with engagement grooves into which respective lateral edges of said ear part of said flat cable are inserted.

19. A connecting structure as claimed in claim 18, wherein respective lateral edges of said ear holding wall of said holder means are also inserted into said engagement grooves.

20. A connecting structure as claimed in claim 11, further comprising holder means detachably attached to said bus-bar unit for holding said ear part of said flat cable on said second setting surface.

21. A connecting structure as claimed in claim 11, wherein said flat cable further includes an exposed conductive part provided by eliminating said insulator partially.

22. A connecting structure as claimed in claim 21, wherein said ear part is arranged perpendicular to an extending direction of said flat cable by bending said conductors at said exposed conductive part in a direction perpendicular to a plane of said flat cable.

23. A connecting structure as claimed in claim 21, wherein said exposed conductive part of said flat cable is mounted on said first setting surface so that said conductors at said exposed conductive part correspond to exposed parts of said bus bars, respectively.

24. A connecting structure as claimed in claim 21, further comprising joint means for joining exposed conductors at said exposed conductive part of said flat cable in a mounted condition to exposed parts of said bus bars.

25. A connecting structure as claimed in claim 11, wherein said bus-bar unit further includes a plurality of exposed parts of said bus bars arranged on said first setting surface and supported thereon at predetermined intervals.

26. A connecting structure as claimed in claim 11, wherein said ear part of said flat cable is attached to said ear holding part.

* * * * *